US009828901B2

(12) United States Patent
Zahdeh

(10) Patent No.: US 9,828,901 B2
(45) Date of Patent: Nov. 28, 2017

(54) ENGINE ASSEMBLY INCLUDING A COOLANT GALLERY

(71) Applicant: GM GLOBAL TECHNOLOGY OPERATIONS LLC, Detroit, MI (US)

(72) Inventor: Akram R. Zahdeh, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 188 days.

(21) Appl. No.: 14/951,714

(22) Filed: Nov. 25, 2015

(65) Prior Publication Data

US 2016/0252002 A1 Sep. 1, 2016

Related U.S. Application Data

(60) Provisional application No. 62/121,737, filed on Feb. 27, 2015.

(51) Int. Cl.
*F01P 3/12* (2006.01)
*F01P 3/02* (2006.01)

(52) U.S. Cl.
CPC *F01P 3/12* (2013.01); *F01P 3/02* (2013.01); *F01P 2060/12* (2013.01); *F01P 2060/16* (2013.01)

(58) Field of Classification Search
CPC ..... F01P 11/04; F01P 3/02; F01P 3/12; F01P 2060/12; F01P 2060/16
See application file for complete search history.

(56) References Cited

U.S. PATENT DOCUMENTS

2009/0114171 A1* 5/2009 Hayashi ..... F01P 3/02 123/41.44
2013/0239915 A1* 9/2013 Beyer ..... F02F 1/40 123/41.74

* cited by examiner

*Primary Examiner* — Jacob Amick
(74) *Attorney, Agent, or Firm* — Quinn IP Law

(57) ABSTRACT

An engine assembly includes a turbocharger and a fluid conduit thermally coupled to the turbocharger such that the coolant flowing through the fluid conduit can extract heat from the turbocharger. The engine assembly further includes an exhaust gas recirculation (EGR) system and a second fluid conduit thermally coupled to the EGR system such that the coolant flowing through the second fluid conduit can extract heat from the EGR system. The engine assembly also includes an engine head defining a coolant gallery extending therethrough. The coolant gallery is in fluid communication with the first fluid conduit and the second fluid conduit. Further, the engine assembly includes an exhaust manifold integrated with the engine head. The coolant gallery is thermally coupled to the exhaust manifold such that the coolant flowing through the coolant gallery can extract heat from the exhaust manifold.

9 Claims, 3 Drawing Sheets

ENGINE ASSEMBLY INCLUDING A COOLANT GALLERY

CROSS-REFERENCE TO RELATED APPLICATIONS

This application claims the benefit of U.S. Provisional Application No. 62/121,737, filed Feb. 27, 2015, which is hereby incorporated by reference in its entirety.

TECHNICAL FIELD

The present disclosure relates to an engine assembly including a coolant gallery.

BACKGROUND

In a vehicle, an engine assembly may include cooling systems to cool various vehicle components. For example, a turbocharger may employ a cooling system to maintain an optimum temperature during operation. Similarly, a vehicle may include an exhaust cooling system. A suitable coolant can be used in those cooling systems. After the cooling process, the coolant is usually hot.

SUMMARY

To maximize fuel efficiency when an internal combustion engine is warming up, the engine oil should be heated to an optimum temperature as quickly as possible. When the oil is at its optimum temperature, fuel dilution in the oil can be minimized. In addition, the moisture in the oil can be minimized by maintaining the oil temperature at its optimum level, thereby maximizing the engine oil life. Accordingly, heat can be extracted from the turbocharger, the exhaust manifold, and/or exhaust gas recirculation (EGR) system in order to warm up the engine oil. For example, coolant can extract heat from the turbocharger and the EGR system, and the coolant can then be introduced into a coolant gallery. In the present disclosure, the term "coolant" refers to any fluid (e.g., liquid) suitable for transferring heat. As a non-limiting example, the coolant may be ethylene glycol. The resulting hot coolant can then be used to heat the engine oil. In an embodiment, the presently disclosed engine assembly includes a turbocharger and a first fluid conduit configured to carry a coolant. The fluid conduit is thermally coupled to the turbocharger such that the coolant flowing through the first fluid conduit can extract heat from the turbocharger. The engine assembly further includes an exhaust gas recirculation (EGR) system and a second fluid conduit configured to carry the coolant. The second fluid conduit is thermally coupled to the EGR system such that the coolant flowing through the second fluid conduit can extract heat from the EGR system. The engine assembly also includes an engine head defining a coolant gallery extending therethrough. The coolant gallery is in fluid communication with the first fluid conduit and the second fluid conduit in order to allow coolant to flow from the first fluid conduit and the second fluid conduit to the coolant gallery. Further, the engine assembly includes an exhaust manifold integrated with the engine head. The coolant gallery is thermally coupled to the exhaust manifold such that the coolant flowing through the coolant gallery can extract heat from the exhaust manifold.

The above features and advantages and other features and advantages of the present teachings are readily apparent from the following detailed description of the best modes for carrying out the teachings when taken in connection with the accompanying drawings.

BRIEF DESCRIPTION OF THE DRAWINGS

1 is a schematic illustration of an engine assembly including a turbocharger, a manifold, a surge tank, and an exhaust manifold;

2 is a schematic, perspective view of the engine assembly schematically illustrated in 1, including an engine head and the coolant manifold coupled to the engine head;

Figure 1:
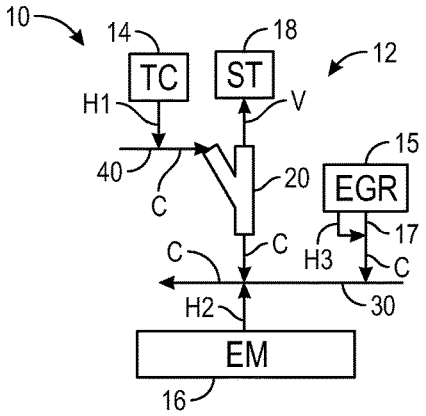
Figure 2:
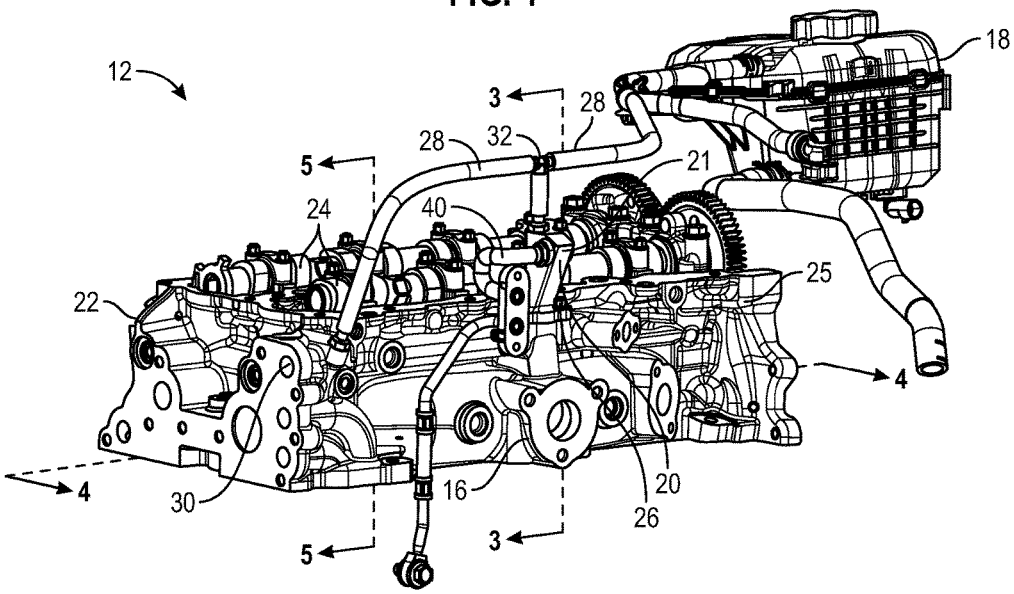
Figure 3:
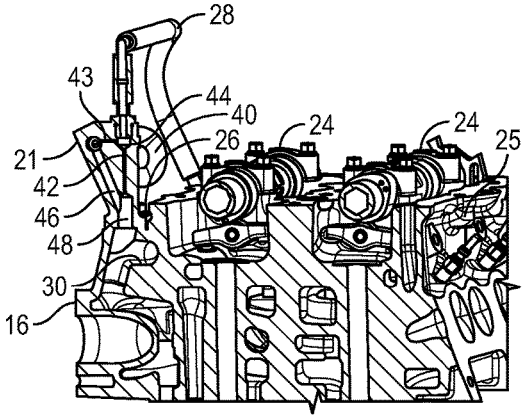
Figure 4:
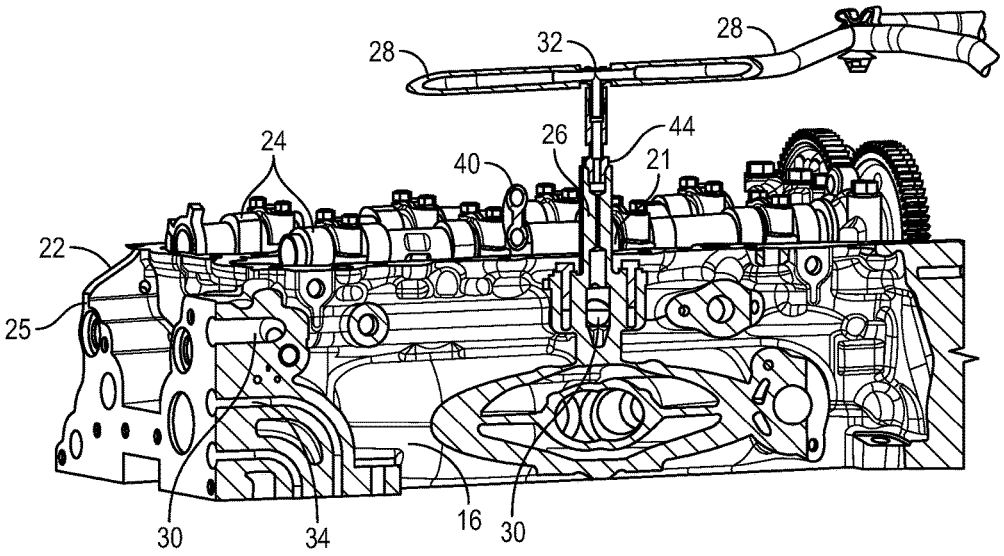
Figure 5:
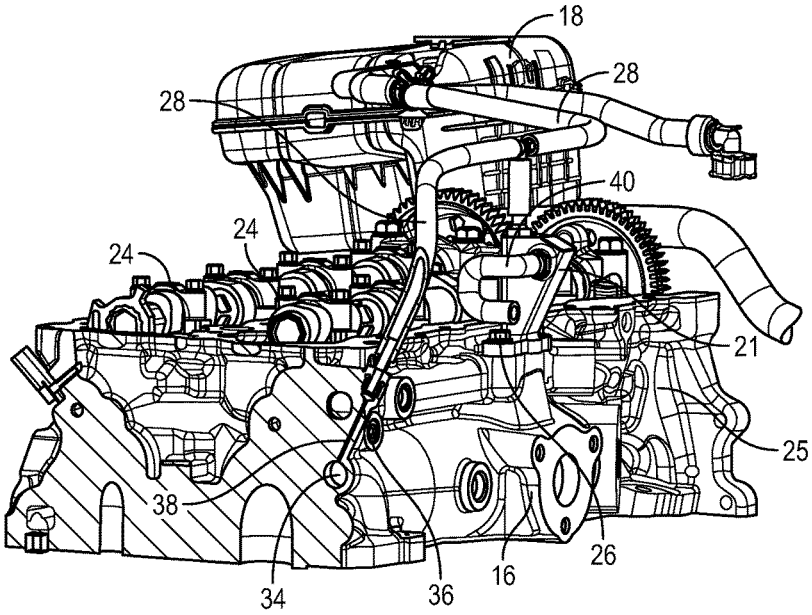

3 is a schematic, sectional, perspective front view of the engine head and the coolant manifold, taken along section line 3-3 of 2;

4 is a schematic, sectional, perspective side view of the engine head and the coolant manifold, taken along section line 4-4 of 2;

5 is a schematic, sectional, perspective front view of the engine head and the coolant manifold, taken along section line 5-5 of 2;

6 is a schematic, partial perspective view of the engine assembly of 1; and

7 is a schematic, sectional, perspective view of the engine assembly, taken along section line 7-7 of 6.

DETAILED DESCRIPTION

Referring to the drawings, wherein like reference numbers correspond to like or similar components throughout the several figures, and beginning with 1, an engine assembly 12, which may be part of a vehicle 10, such as a car, truck, or motorcycle, includes a coolant manifold 20, a turbocharger 14 (TC), and an exhaust manifold 16 (EM). In the depicted embodiment, the engine assembly 12 includes a first fluid conduit 40, such as a pipe, tube, or any suitable conduit, thermally coupled to the turbocharger 14. Accordingly, the coolant C flowing through the first fluid conduit 40 can extract heat (i.e., the extracted turbocharger heat H1) from the turbocharger 14, thereby warming up the coolant C flowing through the first fluid conduit 40. The first fluid conduit 40 is fluidly coupled to the coolant manifold 20. Therefore, hot coolant C can flow from the first fluid conduit 40 to the coolant manifold 20. As discussed in detail below, the coolant manifold 20 can vent vapors V from the hot coolant C and direct the vapors V to a surge tank 18 (ST). The coolant manifold 20 is in fluid communication with a coolant gallery 30 that carries coolant C. Thus, the hot coolant C can flow from the coolant manifold 20 to the coolant gallery 30. The coolant gallery 30 may already contain coolant C. Thus, the coolant C coming from the coolant manifold 20 is joined with the coolant C flowing through the coolant gallery 30. The coolant C flowing through the coolant gallery can extract heat (i.e., the extracted exhaust heat H2) from the exhaust manifold 16.

The engine assembly 12 further includes an exhaust gas recirculation (EGR) system 13 including an EGR cooler 15. Coolant C can flow through the EGR cooler 15 and into a second fluid conduit 17. The second fluid conduit 17 is thermally coupled to the EGR system 13. Therefore, the coolant C flowing through the second fluid conduit 17 can extract heat (i.e., the EGR extracted heat H3) from the EGR system 13.

In the depicted embodiment, the coolant manifold 20 may be referred to as a Y-manifold and is wholly or partly made of a rigid material, such as a rigid metal. The coolant manifold 20 includes a manifold body 21 and can carry coolant (i.e., the first coolant Fl). The coolant manifold 20 is fluidly coupled to the surge tank 18 (ST). As used herein, the term "surge tank" refers to a storage reservoir capable of absorbing sudden rises in pressure. In the depicted embodiment, the surge tank 18 can collect vapors V resulting from the hot coolant C. As discussed below, the coolant manifold 20 minimizes the amount of coolant C that ends up in the surge tank 18, because the liquefied portion of the coolant C does not flow to the surge tank 18. Rather, the coolant manifold 20 vents the coolant C in order to direct the vapors V of the coolant C to the surge tank 18.

With reference to FIGS. 2-7, the engine assembly 12 includes an engine head 22, a plurality of camshafts assemblies 24 supported by the engine head 22, and an engine block 23 coupled to the engine head 22. The engine assembly 12 further includes the coolant manifold 20 directly coupled to the engine head 22. In the depicted embodiment, at least one fastener 26, such as a bolt, extends through the coolant manifold 20 and the engine head 22 in order to couple the coolant manifold 20 to the engine head 22. The exhaust manifold 16 can be integrated with the engine head 22. Therefore, the exhaust manifold 16 can be referred to as the integrated exhaust manifold.

The engine assembly 12 further includes a venting conduit 28, such as a pipe, tube, or any conduit suitable to fluidly couple the coolant manifold 20 to the surge tank 18. The venting conduit 28 allows vapors V ( 1) from the coolant C to flow from the coolant manifold 20 to the surge tank 18. Consequently, vapors V in the coolant manifold 20 can flow to the surge tank 18 through the venting conduit 28. In addition to the coolant manifold 20, the venting conduit 28 is fluidly coupled to the engine cooling system 34 of the engine head 22. Accordingly, the vapors V in the engine cooling system 34 can flow to the surge tank 18 through the venting conduit 28. A T-coupling 32 can couple the venting conduit 28 to the coolant manifold 20 as shown in 5. A conduit vent 36 and a conduit vent orifice 38 are fluidly coupled the engine cooling system 34 and the venting conduit 28, thereby allowing vapors V to flow from the engine cooling system 34 to the surge tank 18 through the venting conduit 28.

The engine head 22 defines a coolant gallery 30 configured, shaped, and sized to carry C and is thermally coupled to the exhaust manifold 16. Accordingly, the coolant C flowing through the coolant gallery 30 can extract heat (i.e., the extracted exhaust heat H2) from the exhaust manifold 16. In the depicted embodiment, the coolant gallery 30 is formed by the engine head 22. The engine head 22 includes a head body 25, and the coolant gallery 30 can be a hole or opening extending through the engine head 22. In particular, the coolant gallery 30 is in direct fluid communication with the coolant manifold 20 and, therefore, coolant C can flow from the coolant manifold 20 to the coolant gallery 30.

The coolant manifold 20 fluidly interconnects the first fluid conduit 40, the venting conduit 28, and the coolant gallery 30. In the depicted embodiment, the coolant manifold 20 defines a venting orifice 42 and a joint vent 44 in fluid communication with the venting orifice 42. The joint vent 44 is in fluid communication with the venting conduit 28 through the T-coupling 32 and therefore allows vapor V to flow to the surge tank 18 through the venting conduit 28. The venting orifice 42 is also in fluid communication with the coolant gallery 30. Thus, vapors V can flow from the coolant gallery 30 to the surge tank 18.

The coolant manifold 20 also defines a joint passageway 46 obliquely angled relative to the venting orifice 42. In the depicted embodiment, the joint passageway 46 can be referred to as the turbocharger return passageway. The joint passageway 46 is fluidly coupled to the first fluid conduit 40. Therefore, hot coolant C can flow from the first fluid conduit 40 to the coolant manifold 20 through the joint passageway 46. Another venting orifice 43 (i.e., a second venting orifice) can be in direct fluid communication with the joint vent 44 and the joint passageway 46, thereby allowing vapors V to flow from the joint passageway 46 to the surge tank 18 through the joint vent 44. The joint passageway 46 has a larger cross-sectional area than the venting orifices 42 and 43 in order to minimize the flow of liquid to the surge tank 18 through the venting orifices 42 and 43.

The coolant manifold 20 further defines an interconnection passageway 48 in direct fluid communication with the joint passageway 46 and the venting orifice 42. The interconnection passageway 48 is fluidly coupled to the coolant gallery 30 in order to facilitate fluid flow of liquefied coolant C from the coolant manifold 20 to the coolant gallery 30. Moreover, the interconnection passageway 48 allows vapor V from the coolant C to flow to the surge tank 18 through the venting orifice 42. The joint passageway 46 is obliquely angled relative to the venting orifice 42 and the interconnection passageway 48 in order to facilitate the flow of coolant C toward the coolant gallery 30 formed in the engine head 22. The interconnection passageway 48 and the joint passageway 46 each have a larger cross-sectional area than the venting orifices 42 and 43 in order to minimize the flow of liquid to the surge tank 18 through the venting orifice 42 and 43. The interconnection passageway 48 and the venting orifice 42 are parallel to each other in order to facilitate venting.

Figure 6:
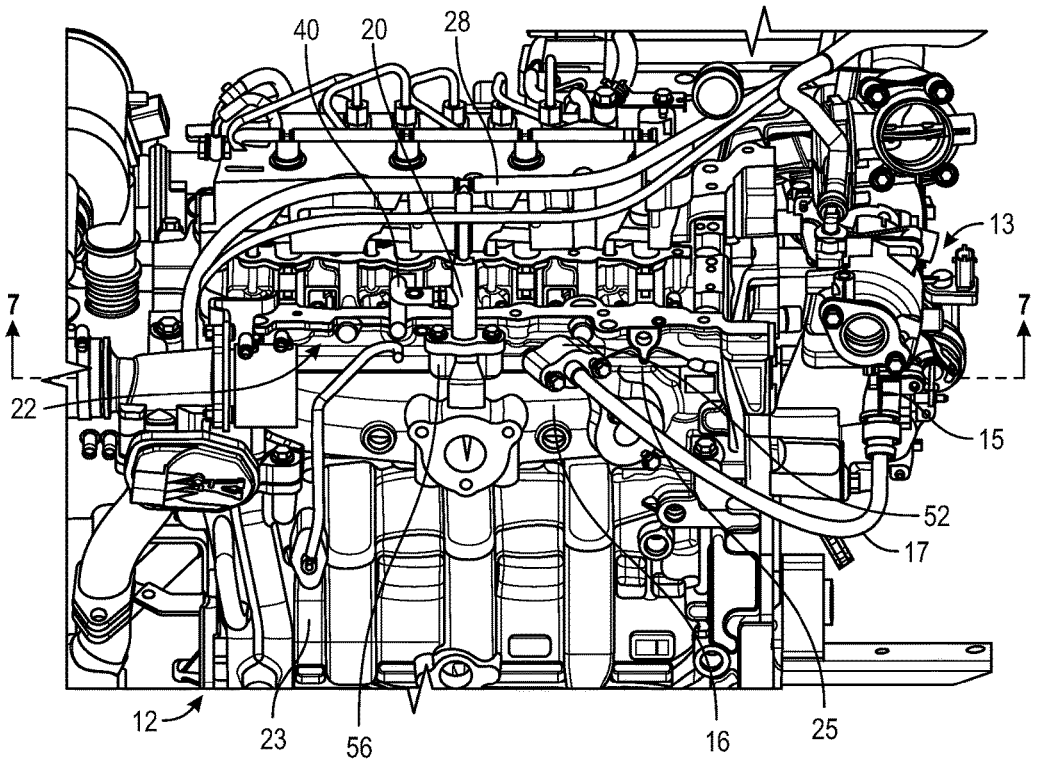
Figure 7:
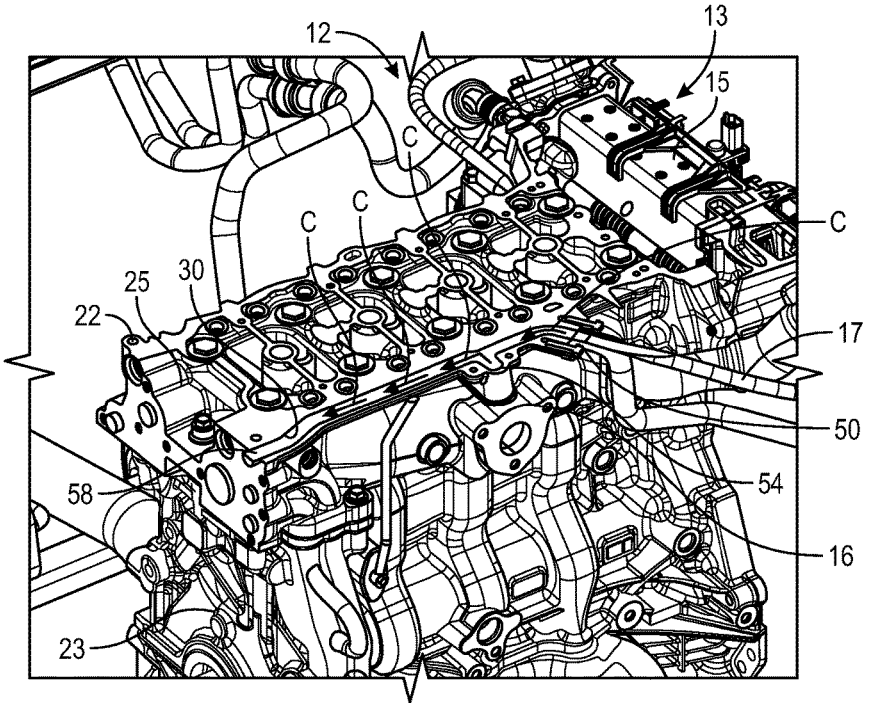

With reference to FIGS. 1, 6, and 7, the engine assembly 12 also includes the EGR system 13, which has the EGR cooler 15. The EGR cooler 15 is in fluid communication with the second fluid conduit 17. The coolant C flowing through the second fluid conduit 17 can extract heat from the EGR system 13. The second fluid conduit 17 is in fluid communication with the coolant gallery 30, thereby allowing the coolant C to flow from the second fluid conduit 17 to the coolant gallery 30. The coolant gallery 30 defines a first inlet 50 formed by a first flange 52 protruding from the head body 25. The first inlet 50 is in fluid communication with the second fluid conduit 17 and the EGR cooler 15. Accordingly, coolant C can flow from the EGR cooler 15 to the first inlet 50 of the coolant gallery 30 through the second fluid conduit 17. As discussed above, the coolant C flowing through the second fluid conduit 17 can extract heat from the EGR system 13 and can then flow to the coolant gallery 30 through the first inlet 50.

The coolant gallery 30 defines a second inlet 54 formed by a second flange 56 protruding from the head body 25. The second flange 56 supports the coolant manifold 20. The coolant manifold 20 can be directly coupled to the second flange 56 and fluidly interconnects the first fluid conduit 40 and the second inlet 54 of the coolant gallery 30. As discussed above, the coolant C flowing through the first fluid conduit 40 can extract heat from the turbocharger 14 and can then flow into the coolant gallery 30 through the coolant manifold 20 and the second inlet 54.

The coolant gallery 30 further defines an outlet 58 such that coolant C can flow from the first inlet 50 to the outlet 58. The outlet 58 of the coolant C can be fluidly coupled to a thermal management module capable of managing the flow of coolant C to other vehicle components. The second inlet 54 is disposed between the first inlet 50 and the outlet 58. Accordingly, the outlet 58 is in fluid communication with the first inlet 50 and the second inlet 54, thereby allowing coolant C to flow toward the outlet 58. As discussed above, the coolant gallery 30 can be configured as a hole extending through the head body 25 from the first inlet 50 to the outlet 58.

During operation of the engine assembly 12, coolant C flows through the EGR cooler 15 and can extract heat from the EGR system 13. Then, the coolant C flows to the coolant gallery 30 through the second fluid conduit 17. In addition, coolant C can flow through the first fluid conduit 40 while heat is extracted from the turbocharger 14. As discussed above, because the first fluid conduit 40 is thermally coupled to the turbocharger 14, the coolant C can extract heat from the turbocharger 14 and can then flow to the coolant gallery 30 through the first fluid conduit 40 and the coolant manifold 20. Specifically, the coolant C flows from the first fluid conduit 40 to the joint passageway 46 of the coolant manifold 20. Vapors V from the coolant C can flow through the venting orifice 43 and the joint vent 44 into the surge tank 18 through the venting conduit 28. In other words, the vapors V from the hot coolant are vented through the venting orifice 43 and the joint vent 44. Vapors V from the coolant C flowing through the coolant gallery 30 can also be vented through the venting orifice 42 and the joint vent 44. The liquefied coolant C continues to flow from the interconnection passageway 48 into the coolant gallery 30 formed by the engine head 22. The coolant C flowing through the coolant gallery 30 can extract heat from the exhaust manifold 16. The coolant C flowing through the coolant gallery 30 can be delivered to a thermal control module through the outlet 58 and can be used, for example, to warm up engine oil and can help maintain the engine oil at its optimum temperature.

While the best modes for carrying out the teachings have been described in detail, those familiar with the art to which this disclosure relates will recognize various alternative designs and embodiments for practicing the teachings within the scope of the appended claims. Although the disclosed method is described in a specific chronological order, it is envisioned that the disclosed method may be performed in a different chronological order.

The invention claimed is:

1. An engine assembly, comprising:

a turbocharger;

a first fluid conduit configured to carry a coolant, wherein the first fluid conduit is thermally coupled to the turbocharger such that the coolant flowing through the first fluid conduit can extract heat from the turbocharger;

an exhaust gas recirculation (EGR) system;

a second fluid conduit configured to carry the coolant, wherein the second fluid conduit is thermally coupled to the EGR system such that the coolant flowing through the second fluid conduit can extract heat from the EGR system; and an engine head defining a coolant gallery extending therethrough, wherein the coolant gallery is in fluid communication with the first fluid conduit and the second fluid conduit in order to allow the coolant to flow from the first fluid conduit and the second fluid conduit to the coolant gallery;

an exhaust manifold integrated with the engine head, wherein the coolant gallery is thermally coupled to the exhaust manifold such that the coolant flowing through the coolant gallery can extract heat from the exhaust manifold;

wherein the EGR system includes an EGR cooler, and the coolant gallery includes a first inlet in fluid communication with the EGR cooler in order to allow fluid flow of the coolant from the EGR cooler to the coolant gallery;

wherein the coolant gallery defines a second inlet in fluid communication with the first fluid conduit in order to allow fluid flow of the coolant from the first fluid conduit to the coolant gallery;

wherein the coolant gallery defines an outlet in fluid communication with the first inlet and the second inlet in order to allow the coolant to flow toward the outlet;

a coolant manifold fluidly interconnecting the first fluid conduit and the second inlet; and a surge tank in fluid communication with the coolant manifold, wherein the coolant manifold allows vapor to vent into the surge tank.

2. The engine assembly of claim 1, further comprising a venting conduit fluidly interconnecting the surge tank and the coolant manifold.

3. The engine assembly of claim 2, wherein the engine head includes a head body, and the coolant gallery is a hole extending through the head body.

4. The engine assembly of claim 3, wherein the hole extends from the first inlet to the outlet.

5. The engine assembly of claim 4, wherein the second inlet is located between the first inlet and the outlet.

6. The engine assembly of claim 5, wherein the engine head includes a first flange protruding from the head body, and the first inlet is formed by the first flange.

7. The engine assembly of claim 6, wherein the head includes a second flange protruding from the head body, and the second inlet is formed by the second flange.

8. The engine assembly of claim 7, wherein the coolant manifold is directly coupled to the second flange.

9. The engine assembly of claim 8, wherein the second fluid conduit is directly coupled to the second flange in order to fluidly couple the second fluid conduit to the first inlet.

* * * * *